US010058759B1

(12) United States Patent
Saint-Louis

(10) Patent No.: US 10,058,759 B1
(45) Date of Patent: Aug. 28, 2018

(54) GOLF TRAINING AID APPARATUS AND METHOD

(71) Applicant: Leslie A. Saint-Louis, New York, NY (US)

(72) Inventor: Leslie A. Saint-Louis, New York, NY (US)

( * ) Notice: Subject to any disclaimer, the term of this patent is extended or adjusted under 35 U.S.C. 154(b) by 0 days.

(21) Appl. No.: 15/657,983

(22) Filed: Jul. 24, 2017

(51) Int. Cl.
*A63B 69/36* (2006.01)
*A63B 71/06* (2006.01)
*A63B 102/32* (2015.01)

(52) U.S. Cl.
CPC ..... *A63B 69/3661* (2013.01); *A63B 71/0622* (2013.01); *A63B 71/0686* (2013.01); *A63B 2102/32* (2015.10); *A63B 2207/02* (2013.01); *A63B 2220/51* (2013.01); *A63B 2220/56* (2013.01); *A63B 2220/62* (2013.01); *A63B 2220/833* (2013.01)

(58) Field of Classification Search
CPC ..... A63B 69/3661; A63B 71/0622
USPC ..... 473/151, 220, 221, 222, 225, 278, 279, 473/409
See application file for complete search history.

(56) References Cited

U.S. PATENT DOCUMENTS 5,040,790 A * 8/1991 Anthes ..... A63B 71/0686 273/446
5,472,205 A * 12/1995 Bouton ..... A63B 69/3614 473/222
5,718,639 A * 2/1998 Bouton ..... A63B 69/3614 473/151
6,458,038 B1 * 10/2002 Lin ..... A63B 69/3614 362/259
7,104,900 B1 * 9/2006 Finley ..... A63B 69/3623 273/108
2004/0137999 A1 * 7/2004 Park ..... A63B 69/3623 473/278
2005/0197198 A1 * 9/2005 Otten ..... A63B 69/3614 473/221
2007/0298896 A1 * 12/2007 Nusbaum ..... A63B 69/36 473/131

* cited by examiner

*Primary Examiner* — Nini Legesse
(74) *Attorney, Agent, or Firm* — Amster, Rothstein & Ebenstein, LLP

(57) ABSTRACT

A golf training aid apparatus having a sensor mat for being placed under a golf mat, the sensor mat having one or more first sensors disposed in a first region; one or more second sensors disposed in a second region; and one or more third sensors disposed in a third region. The apparatus having a timer circuit coupling each of the first, second, and third sensors to a respective first indicator, second indicator, and third indicator, the timer circuit triggering, over a predetermined amount of time, the first indicator upon an ideal impact detected by the one or more first sensors, the second indicator upon a thin impact detected by the one or more second sensors, or the third indicator upon a fat impact detected by the one or more third sensors.

13 Claims, 9 Drawing Sheets

400a

GOLF TRAINING AID APPARATUS AND METHOD

FIELD OF THE INVENTION

The present invention relates to athletic training aids and, more particularly, to methods and apparatuses for providing timely feedback on a club head impact point of a golf swing.

BACKGROUND OF THE INVENTION

Golf is a globally popular sport with many enthusiasts. It is widely known as a sport that is difficult to master and there have been many training videos, apparatuses, magazines, guides, schools, etc., devoted to helping players improve their game. Crucial skill elements to a golf game include putting, chipping, pitching, and ball striking, each with their unique requirements and corresponding practice environments. Putting may be practiced on a practice green and chipping/pitching may be practiced either at a driving range or a devoted practice green with extended chipping/pitching areas. Ball striking is usually practiced at a driving range.

Practice greens for practicing putting and/or chipping usually reproduce natural lie conditions of an actual course. For example, many golf courses provide such greens that closely simulate the conditions on the courses themselves. Additionally, some golf courses provide driving ranges that reproduce the lie conditions on, say, the fairways of the courses themselves. However, maintaining such lie conditions on a driving range, particularly for high volume use, is not always practical. As such, many driving ranges, especially standalone practice facilities, provide artificial turf mats for ball striking, pitching, and/or chipping practice.

While artificial mats provide improved durability and, thus, cost reduction, they fail to accurately simulate actual game conditions in important but unobvious ways. For example, a commercial golf mat on a practice driving range is very forgiving. The golf club can hit well behind the golf ball and slide along or bounce over the surface of the mat to hit the ball, resulting in an apparently good ball flight and distance. On the other hand, on the golf course, the ground may not be similarly forgiving due to the softness or other condition of natural turf. A similar swing impacting behind the ball may cause the club head to dig into the ground or otherwise hinder inertia, resulting in a "fat shot" with reduced clubhead speed or direction and a ball flight of lesser distance, perhaps travelling only a few yards. Because the ball hit in a driving range may not show significant limitations in ball travel distance due to a "fat shot," the golfer may not recognize that his club hit the ground behind the ball and thus the practice might not be as productive as it could be.

SUMMARY OF THE INVENTION

It is, therefore, an object of the invention to provide appropriate feedback to a player practicing ball striking, pitching, or chipping off a golf mat at home or at a driving range so that the player is not misled into a false sense of having made a good golf swing by feeling reasonably acceptable impact with the golf mat under the practice ball and by observing an apparently good ball flight after impact.

In accordance with an exemplary embodiment of the invention, a golf training aid apparatus comprises a sensor mat that is adapted to be placed beneath a conventional golf mat. The sensor mat comprises three sensor locations (regions or zones) each provided with one or more pressure or force sensitive switches (sensors) for detecting an impact location of a golf swing on the conventional golf mat. The sensors are coupled to respective indicators, such as LEDs (light emitting diodes) with different colors, for indicating, to the player, corresponding impact locations that are detected by the sensors.

According to an exemplary embodiment of the invention, the sensors are coupled to the indicators via a timing circuit that triggers the respective indicator for a predetermined period of time. The timing circuit is also configured to trigger all of the indicators for the predetermined period of time upon being coupled to an energy source to provide the player with a preview of the indicator duration and proper functioning of all indicators.

The apparatus is further provided with a handedness switch for reassigning the sensor/indicator coupling to accommodate left handed players, who would place the sensor mat beneath the golf mat on an opposite side. In accordance with an alternative embodiment, the components of the golf training aid apparatus may be integrated with a golf mat.

Other features and advantages of the present invention will become readily apparent from the following detailed description and the accompanying drawings.

The above and related objects, features and advantages of the present invention will be more fully understood by reference to the following, detailed description of the preferred, albeit illustrative, embodiment of the present invention when taken in conjunction with the accompanying figures, wherein:

DETAILED DESCRIPTION

Figure 1A:
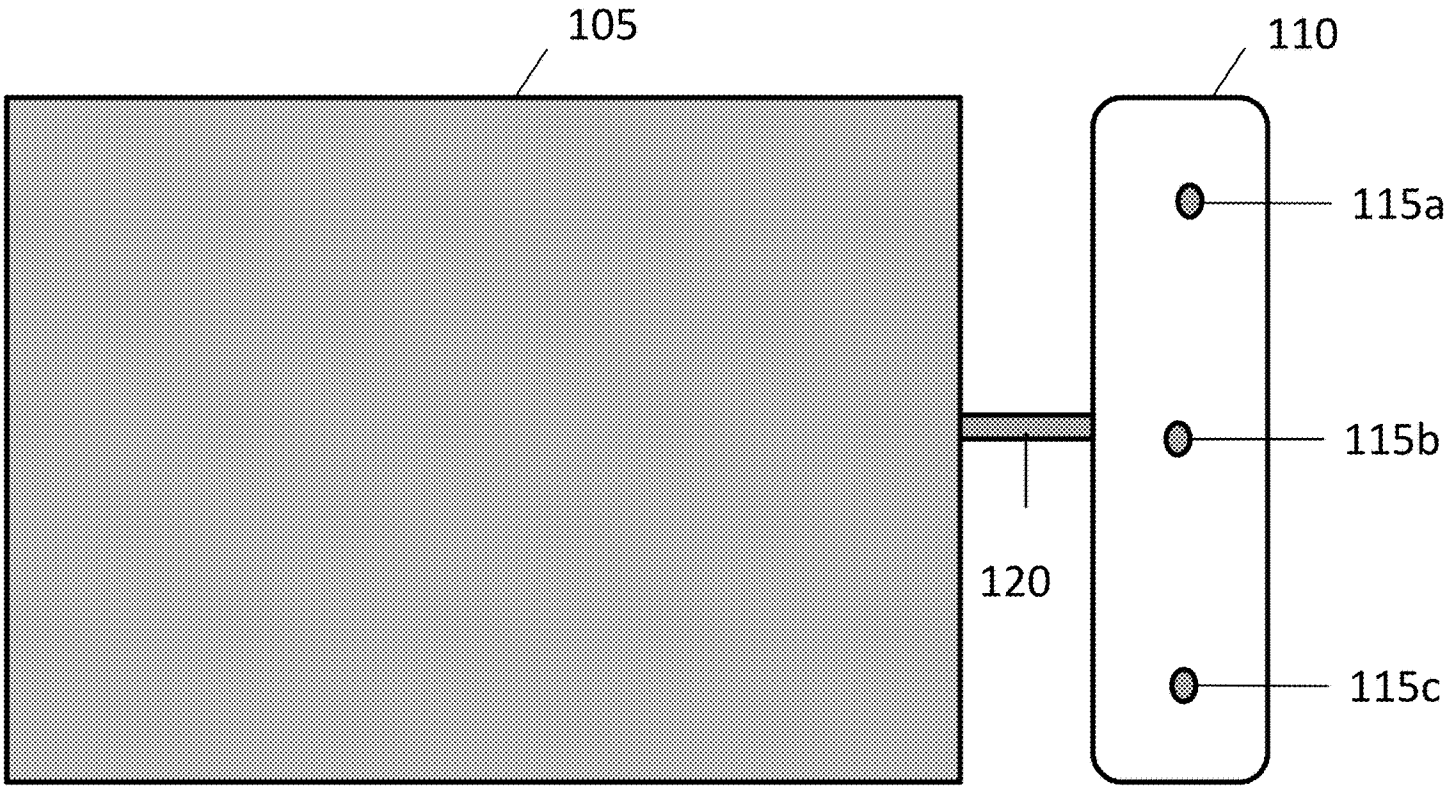
FIG. 1A is a plan view illustrating an exterior configuration of a golf training aid apparatus according to an exemplary embodiment of the invention.

FIG. 1A is a plan view illustrating an exterior configuration of a golf training aid apparatus 100 according to an exemplary embodiment of the invention. As shown in FIG. 1A, apparatus 100 may comprise a sensor mat 105, a housing 110 with indicators 115*a-c*, and a connector 120. In accordance with an exemplary embodiment of the invention, sensor mat 105 may comprise two rubber or vinyl sheets stacked together to form a thin inner enclosure that accommodates pressure sensitive switches or force sensitive resistor switch sensors (hereinafter referred to collectively as "sensors"). Each rubber or vinyl sheet may be, for example, 1/16×8½×11 or 3/32×8½×11 inches—made from a Buna (Nitrile) rubber, or the like—forming a 8½×11 inch sensor mat 105 with a thickness of approximately ⅛ to 3/16 inches including the internal sensors, connectors, couplings, etc. According to an embodiment of the invention, sensor mat 105 may comprise one 3/32×8½×11 inch sheet and one 1/16×8½×11 sheet. The two rubber or vinyl sheets may also be integrated into a singular mat with an internal pocket that accommodates the sensors.

As will be detailed below, sensors within mat 105 are arranged into three rows, each row respectively activating one of the three (3) indicators 115*a*, 115*b*, and 115*c*. According to an exemplary embodiment of the invention, indicators 115*a*, 115*b*, and 115*c* may be light emitting diodes (LEDs), or the like. Indicators 115*a* and 115*c* may be switchable between green (for indicating an ideal impact) and red (for indicating a "fat shot" impact behind the ball) by a "handedness" switch (not shown) on housing 110 for accommodating right-handed and left-handed golfers, as detailed below. Indicator 115*b* may embody a yellow LED for indicating a "thin shot" impact, where the golf swing fails to make a full impact on the ball and the ground after impact with the ball.

Figure 1B:
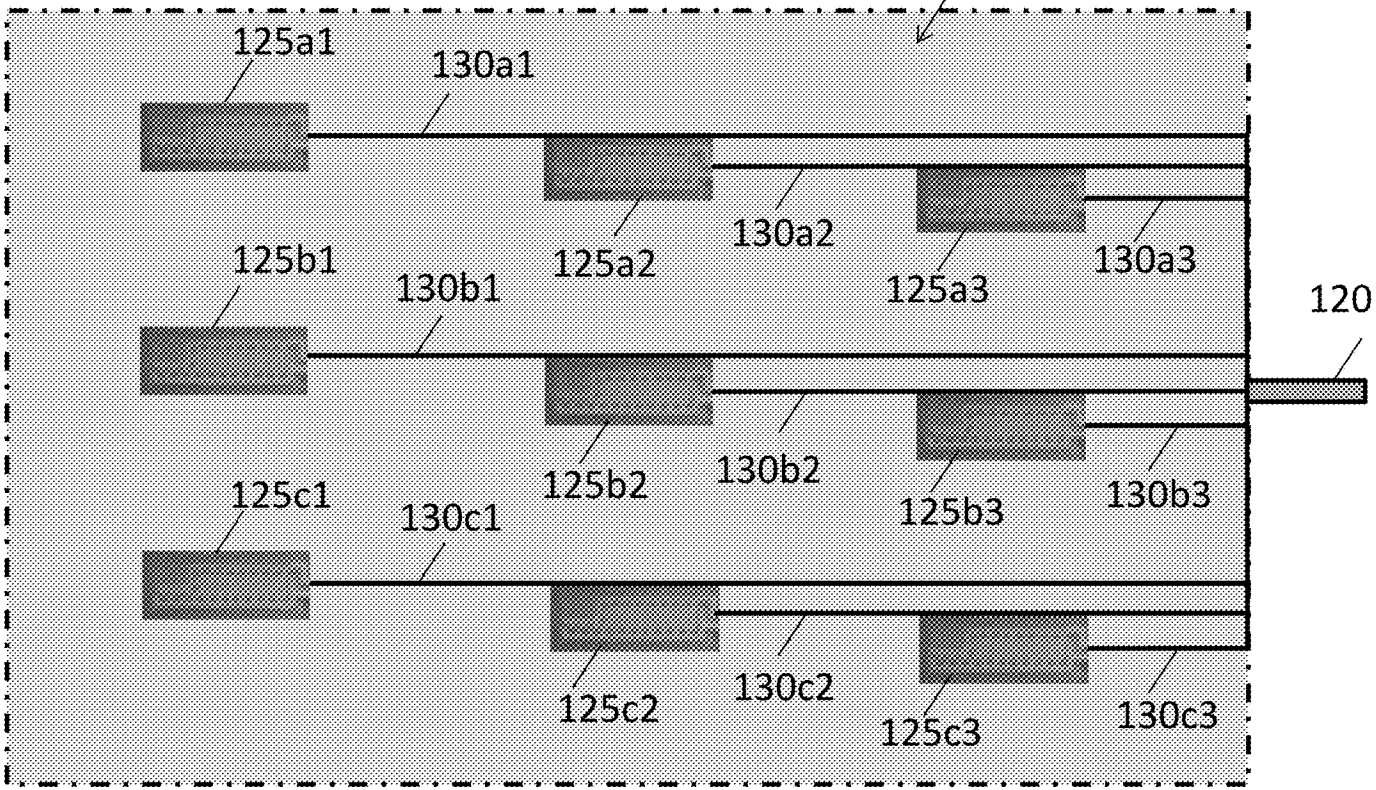
FIG. 1B in a plan section of a sensor mat of the golf training aid apparatus of FIG. 1A in accordance with an exemplary embodiment of the invention.

FIG. 1B illustrates an arrangement of sensors 125 (125*a*1-125*c*3) within the sensor mat 105 shown in FIG. 1A. In accordance with an exemplary embodiment of the invention, sensor mat 105 may comprise two (top and bottom) sheets of rubber (e.g., Buna rubber and the like) or vinyl between which are disposed the sensors 125 illustrated in FIG. 1B. The two (top and bottom) sheets of rubber may be integrated into one unit wherein an internal enclosure houses the sensors 125 in the arrangement shown in FIG. 1B. According to an exemplary embodiment of the invention, the top and bottom sheets of rubber of the sensor mat 125 may be approximately 1/16 to 3/32 inches thick.

As shown in FIG. 1B, sensors 125 may be arranged in three respective rows corresponding to the three impact locations along a swing plane of the player. For example, sensors 125*a*1, 125*a*2, and 125*a*3 may be arranged in a row for detecting a first impact region (or zone or location) that corresponds to indicator 115*a* shown in FIG. 1A—in other words, either an ideal impact for a right handed golfer (green) or a "fat shot" impact for a left handed golfer (red), as detailed below. FIG. 1B illustrates sensors 125*a*1, 125*a*2, and 125*a*3 being arranged in a row with a slight offset for sensors 125*a*2 and 125*a*3 for accommodating the electrical couplings 130*a*1 and 130*a*2 (which, including coupling 130*a*3, may be thin wires or the like), respectively. According to an exemplary embodiment, the slight offset of sensor 125*a*2 may be approximately between 0.1 to 0.5 inches from sensor 125*a*1 and sensor 125*a*3 may, in turn, be offset by approximately between 0.1 and 0.5 inches from sensor 125*a*2 in forming the corresponding row of sensors 125*a*. According to an alternative embodiment, sensors 125*a*1, 125*a*2, and 125*a*3 may be aligned with one another along the row with couplings 130*a*1 and 130*a*2 being arranged around or underneath the sensors 125*a*2 and 125*a*3 without departing from the scope of the invention. According to another alternative embodiment, sensors 125*a*1, 125*a*2, and 125*a*3 may be embodied by one (1), two (2), or more than three (3) individual sensors for detecting an impact in the first region of sensor mat 125 that corresponds to indicator 115*a*. For example, sensors 125*a*1, 125*a*2, and 125*a*3 may be embodied by one continuous vertical sensor 125*a* that is 6" long.

Correspondingly, sensors 125*b*1, 125*b*2, and 125*b*3 may be arranged in a row for detecting a second impact region (zone or location) that corresponds to indicator 115*b* shown in FIG. 1A—in other words, a "thin" impact for either a right handed golfer or a left handed golfer (yellow); and sensors 125*c*1, 125*c*2, and 125*c*3 may be arranged in a row for detecting a third impact region or location that corresponds to indicator 115*c* shown in FIG. 1A—in other words, either a "fat shot" impact for a right handed golfer (red) or an ideal impact for a left handed golfer (green), as detailed below. FIG. 1B illustrates sensors 125*b*1, 125*b*2, and 125*b*3 being arranged in a row with a slight offset for sensors 125*b*2 and 125*b*3 for accommodating the electrical couplings 130*b*1 and 130*b*2 (which, including coupling 130*b*3, may be thin wires or the like), respectively. According to an exemplary embodiment, the slight offset of sensor 125*b*2 may be approximately between 0.1 to 0.5 inches from sensor 125*b*1 and sensor 125*b*3 may, in turn, be offset by approximately between 0.1 to 0.5 inches from sensor 125*b*2 in forming the corresponding row of sensors 125*b*. According to an alternative embodiment, sensors 125*b*1, 125*b*2, and 125*b*3 may be aligned with one another along the row with couplings 130*b*1 and 130*b*2 being arranged around or underneath the sensors 125*b*2 and 125*b*3 without departing from the scope of the invention. According to another alternative embodiment, sensors 125*b*1, 125*b*2, and 125*b*3 may be embodied by one (1), two (2), or more than three (3) individual sensors for detecting an impact in the second region of sensor mat 125 that corresponds to indicator 115*b*. For example, sensors 125*b*1, 125*b*2, and 125*b*3 may be embodied by one continuous vertical sensor 125*b* that is 6" long.

Correspondingly, sensors 125*c*1, 125*c*2, and 125*c*3 are arranged in a row with a slight offset for sensors 125*c*2 and 125*c*3 for accommodating the electrical couplings 130*c*1 and 130*c*2 (which, including coupling 130*c*3, may be thin wires or the like), respectively. According to an exemplary embodiment, the slight offset of sensor 125*c*2 may be approximately between 0.1 to 0.5 inches from sensor 125*c*1 and sensor 125*c*3 may, in turn, be offset by approximately between 0.1 to 0.5 inches from sensor 125*c*2 in forming the corresponding row of sensors 125*c*. According to an alternative embodiment, sensors 125*c*1, 125*c*2, and 125*c*3 may be aligned with one another along the row with couplings 130*c*1 and 130*c*2 being arranged around or underneath the sensors 125*c*2 and 125*c*3 without departing from the scope of the invention. According to another alternative embodiment, sensors 125*c*1, 125*c*2, and 125*c*3 may be embodied by one (1), two (2), or more than three (3) individual sensors for detecting an impact in the third region of sensor mat 125 that corresponds to indicator 115*c*. For example, sensors 125*c*1, 125*c*2, and 125*c*3 may be embodied by one continuous vertical sensor 125*c* that is 6" long.

Sensors 125 (125*a*1-125*c*3) may be pressure sensitive switches (PSS) or force sensing resistor switches (FSR). The rows (125*a*1-3, 125*b*1-3, and 1251-3) are separated by approximately 3"-3.5" from center to center of the respective switches 125—for example, between 125*a*1 and 125*b*1)—and the switches in the respective rows are separated by approximately 2"-2.5" from center-to-center along axes formed by the couplings 130*a*1, 130*b*1, and 130*c*1 shown in FIG. 1B—for example, between sensors 125*a*1 and 125*a*2. According to an exemplary embodiment The sensors 125 have a radius of activation of approximately 1¾-2½ inches depending on the golf mat thickness.

Figure 2A:
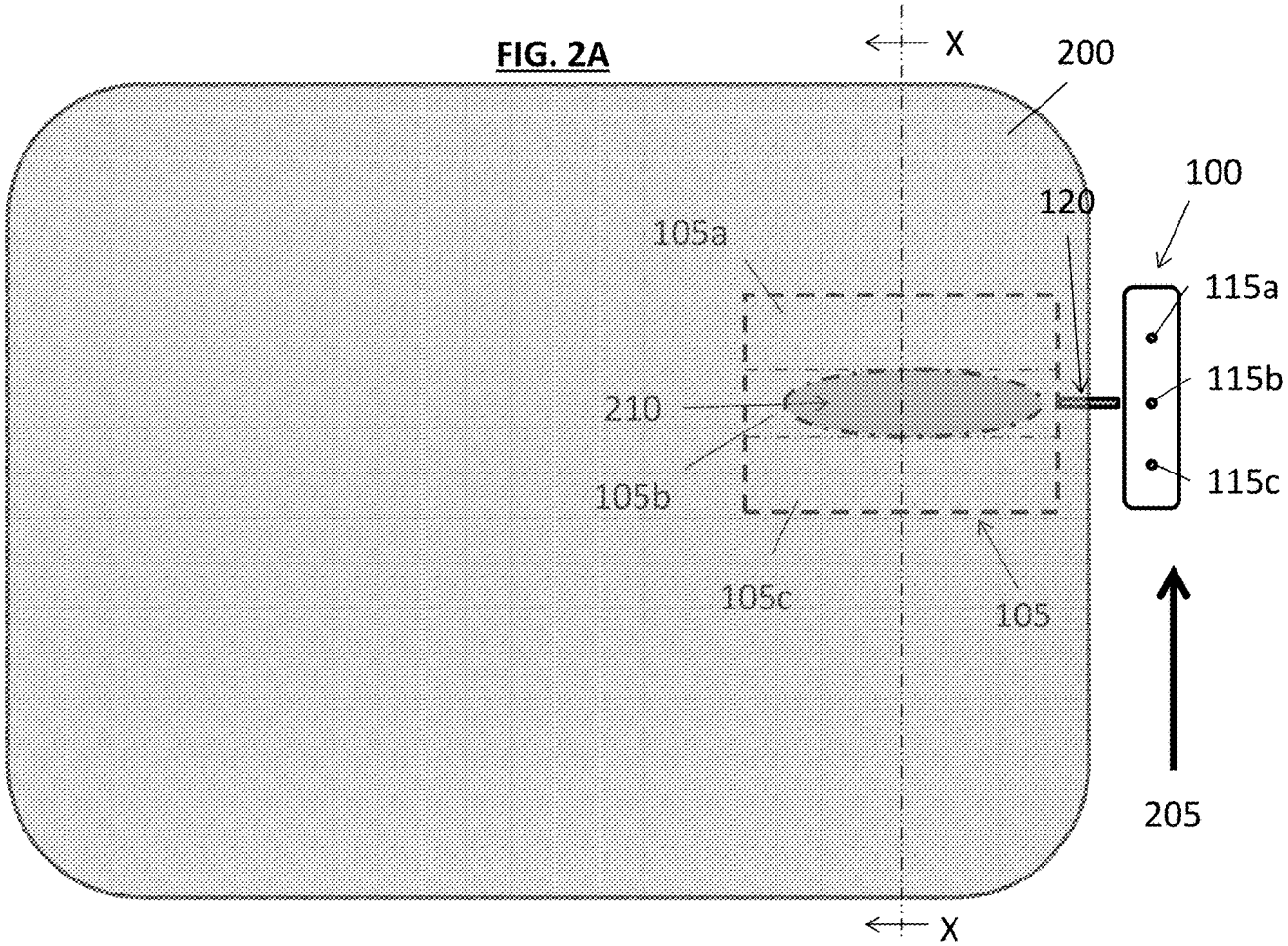
FIGS. 2A and 2B are plan views illustrating the golf training aid apparatus of FIG. 1A in use with a driving range mat for right handed golfers and left handed golfers, respectively, in accordance with an exemplary embodiment of the invention.
Figure 2B:
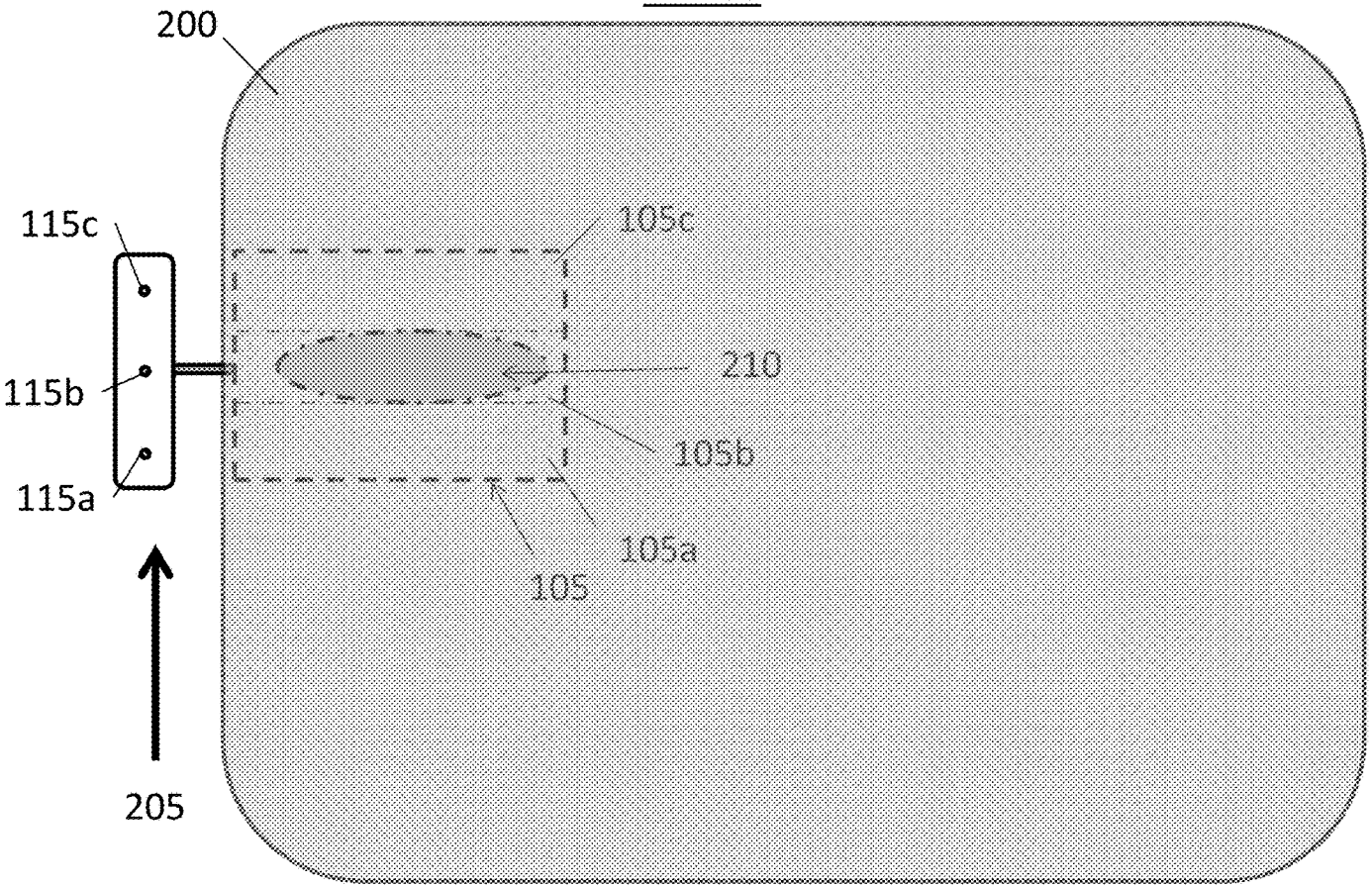

FIG. 2A is a plan view illustrating the use of the golf training aid apparatus 100 with a conventional golf mat 200—for example, at a driving range or at home (say, with a golf net)—by a right handed golfer and FIG. 2B is a plan view illustrating the use by a left handed golfer. As shown in FIGS. 2A and 2B, sensor mat 105 is placed underneath golf mat 200 at a location where a practice ball is to be placed—for example, in ball placement zone indicated by area 210—for chipping, pitching, or striking in the direction 205. As shown in FIGS. 2A and 2B, direction 205 reflects a swing direction axis along which first, second, and third sensor regions 105*a*, 105*b*, and 105*c* are arranged. With reference to FIG. 1B, sensors 125 (125*a*1-125*c*3) are respectively arranged in rows 125*a*, 125*b*, and 125*c* along axes that are orthogonal to the swing direction axis. It is noted that right handed and left handed golfers swing towards the same direction 205 (substantially parallel swing direction axes) in nearly all driving ranges, with a left handed golfer facing an opposite direction, as reflected by the opposite sides of mat 200 shown in FIGS. 2A and 2B, respectively. Again, each row of sensors 125*a*, 125*b*, and 125*c* may be embodied by one (1), two (2), or more than three (3) individual sensors. As further illustrated in FIG. 2A, connector 120, which accommodates couplings 130 (130*a*1-130*c*3) towards internal circuitry in housing 110 corresponding to indicators 115*a*-*c* (which will be described in further detail below), may be situated at a ball placement location such that the golfer may place the practice ball on the golf mat 200 according to the location at which connector 120 extends from under the golf mat 200 towards housing 110 of apparatus 100. As shown in FIGS. 2A and 2B, a golf ball is placed within zone 210, which corresponds to second sensor region 105*b* in line over the center pressure sensitive switch(es) 125*b*1-3 (yellow LED).

According to an embodiment of the invention, apparatus 100 may further comprise a foldable thin bar (not shown) extending from the center outer edge (at zone 105*b*) of the rubber base of sensor mat 105 to fold onto the edge of the golf mat 200 for indicating zone 210 to the golfer. As an example, the foldable bar may be a 1" wide×¾" long, three (3) piece, two hinged plastic or metal center alignment indicator that is attached to the top center edge of the rubber base of mat 105 and that folds over the golf mat 200 to indicate the position of the center switches where the golf ball should be placed (210). Along this line in zone 105*b*, the golf ball can be placed approximately 3" to 11" from the outer edge (proximate housing 110) of the golf mat 200. FIG. 2A further illustrates ideal impact zone 105*a* (for a right handed golfer) corresponding to indicator 115*a* and "fat shot" impact zone 105*c* corresponding to indicator 115*c*. FIG. 2B illustrates ideal impact zone 105*c* (for a left handed golfer) corresponding to indicator 115*c* and "fat shot" impact zone 105*a* corresponding to indicator 115*a*. As detailed below, indicators 115*a* and 115*c* can be changed between green and red by a "handedness" switch (not shown) on housing 110 for the golfer to set right handed or left handed use.

In practice, one of the indicators 115*a*, 115*b*, and 115*c* would light to indicate an impact location of a club head on the mat 200. However, two (2) of the indicators 115, for example, indicators 115*c* and 115*b*, may light up simultaneously to indicate that the club head has slid along the mat 200 greater than three (3) inches but less than six (6) inches. As detailed below with reference to FIGS. 4A-5, the indicators 115 (or LEDs) are configured to stay on for at least 8 seconds when the corresponding pressure sensitive switch(es) 125 is(are) activated to allow time for the golfer to assess the flight and distance of the ball (a proper golf shot with any club usually takes 5-6 seconds to land) before viewing the indicators 115. Shorter pitch and chip shots may take approximately 1-4 seconds before their results become apparent to the golfer. Accordingly, the indicators 115 provide ample time for the golfer to assess a shot before viewing them. Additionally, apparatus 100 may be configured specifically for short shots with shorter indicator 115 durations or it may comprise an additional switch for changing between a "long shot mode," with longer indicator durations, and a "short shot mode," with corresponding shorter indicator durations.

Figures 3A, 3B, 3C:
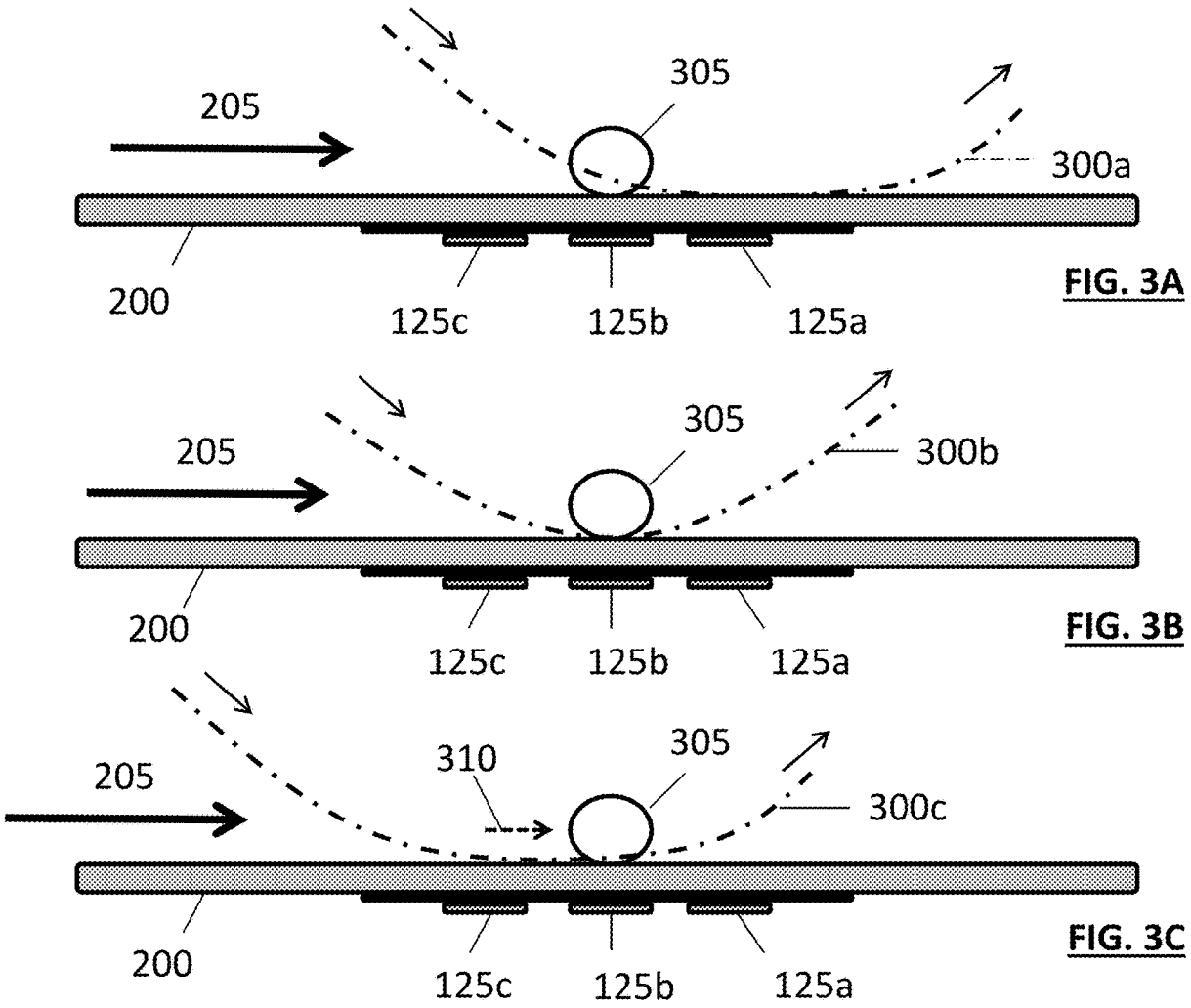
FIGS. 3A-3C are side section views along line X-X in FIG. 2A illustrating an ideal impact, a thin impact, and a fat shot impact, respectively, as detected by the golf training aid apparatus according to an exemplary embodiment of the invention.

FIGS. 3A-3C are side section views along line X-X in FIG. 2A illustrating an ideal impact, a thin impact, and a fat shot impact, respectively, of a right handed golf shot in direction 205 as detected by the golf training aid apparatus 100 according to an exemplary embodiment of the invention. In particular, FIG. 3A illustrates an example of an ideal swing path 300*a* of a golf club head. Correspondingly, FIGS. 3B and 3C illustrate the golf club head swing paths 300*b* and 300*c* for a thin impact and a "fat shot" impact, respectively. As shown in each of FIGS. 3A, 3B, and 3C, a golf ball 305 may be placed on golf mat 200 in and around zone 210 (as illustrated in FIG. 2A) above sensors 125*b* and each of these figures illustrates a golf club head impacting the ball through respective examples of swing paths 300*a*, 300*b*, and 300*c*. It is noted that swing paths 300*a*, 300*b*, and 300*c* are for illustration purposes only and that the arcs of these swing paths may be different depending upon the golf shot (pitch, punch, chip, full strike, etc.) and the club (woods, irons, or rescue clubs) being practiced. As shown in FIG. 3A, for an ideal golf swing 300*a*, a club head impacts upon the ball 305 before hitting the golf mat 200 (or ground) at a location above sensors 125*a* for a right handed golfer. As shown in FIG. 3B, for a thin impact golf swing 300*b*, a club head impacts upon the ball 305 and golf mat 200 simultaneously but does not hit the ball sufficiently through the "sweet spot" of the club head. Sensors 125*b* would detect such an impact and indicator 115b would provide feedback of such a thin impact to the golfer. FIG. 3C shows an example of a "fat shot" golf swing 300*c* where the club head impacts the golf mat 200 (or ground) before the golf ball 305. As described above, a golf mat 200 is more resilient than natural turf at a regular golf course and a club head is often able to slide along on its top surface, as shown by arrow 310. The sliding results in a sufficient impact on golf ball 305 so that the ball flight resembles a regular, albeit imperfect, golf shot of an average player, at times perhaps resembling a thin impact or even an ideal shot. As illustrated in FIG. 3C, sensors 125*c* would detect such a fat impact and alert the golfer, via indicator 115*c*. As noted before, a fat impact golf swing similar to swing 300*c* on a natural turf golf course would result in the club head digging into the ground, substantially slowing the club head and resulting in a "fat shot" that would not adequately advance the golf ball towards the hole. It is also noted that a similar slide along the top surface of mat 200 may occur after an impact with ball 305 in an ideal swing, as shown in FIG. 3A. However, such a slide would be acceptable since the ball has already been hit with an unobstructed swing before impact. Indeed, many kinds of golf shots, if hit correctly, result in divots dug from the ground of a golf course by a club head after impacting a ball.

Figure 4A:
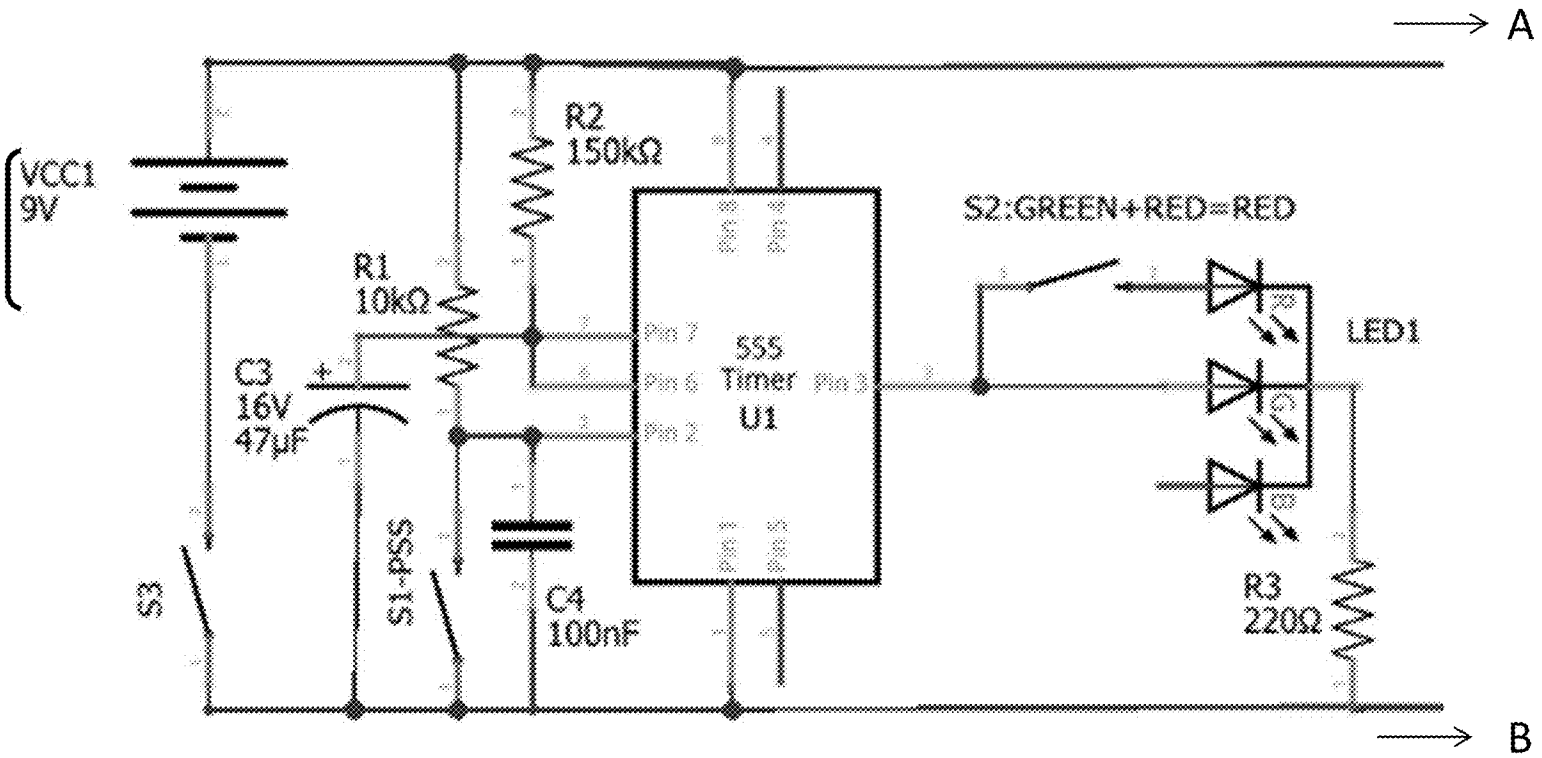
FIGS. 4A-4C are schematic circuit diagrams of the electronic components of the golf training aid apparatus of FIG. 1A.
Figure 4B:
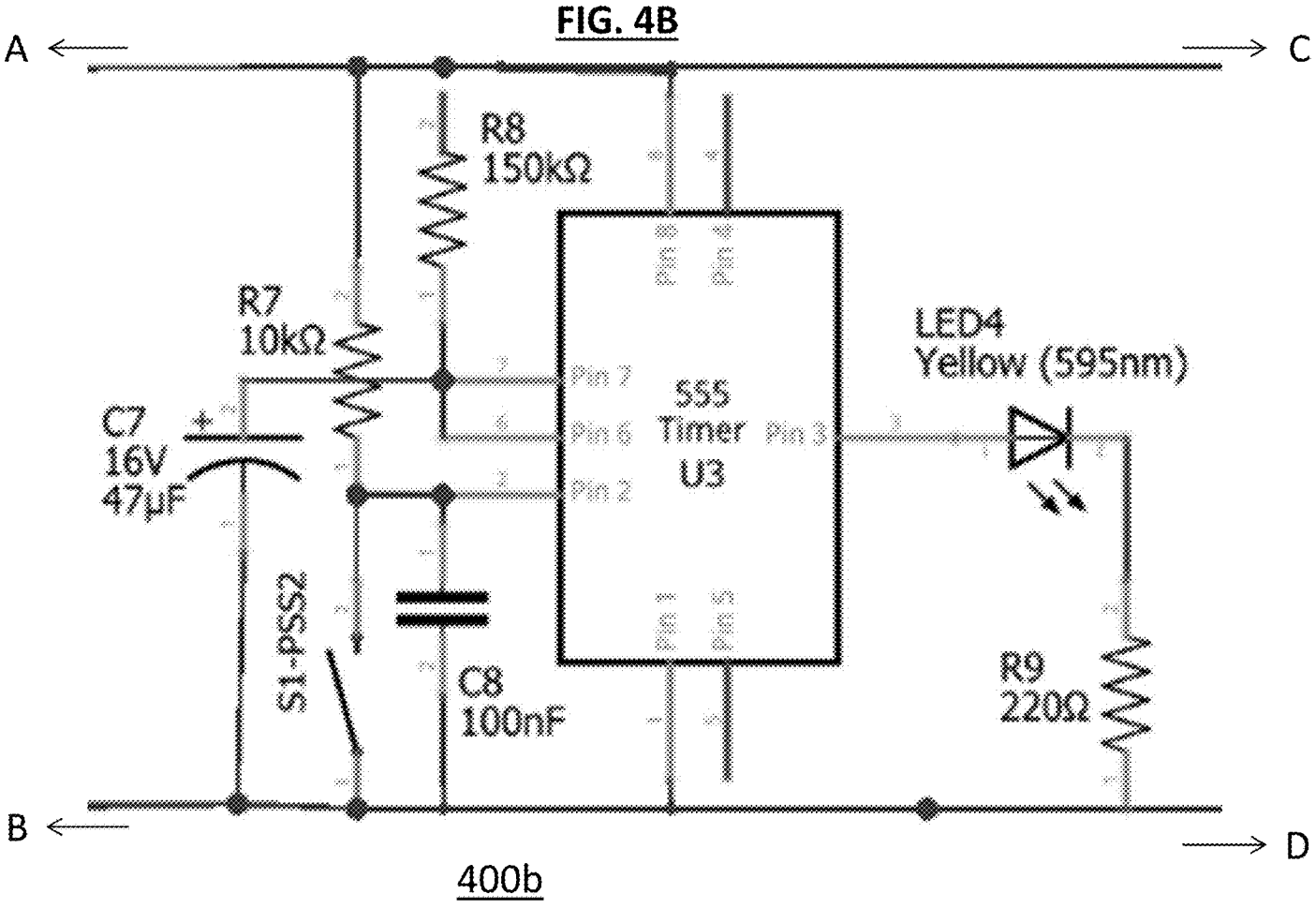
Figure 4C:
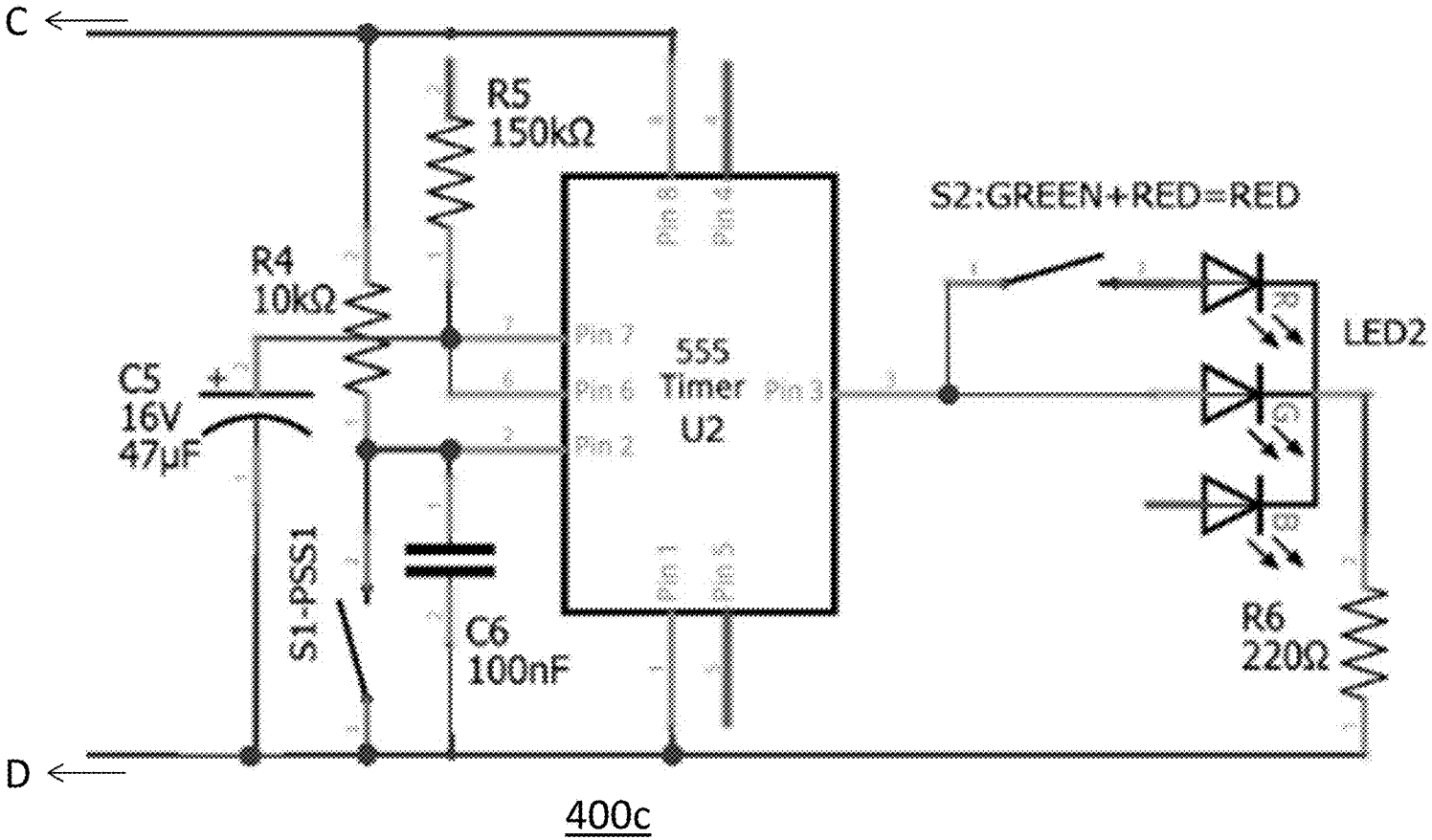

FIGS. 4A, 4B, and 4C illustrate the schematic arrangements of the circuitry 400 (400*a*-*c*), including indicators 115, sensors 125, and components in housing 110, corresponding to the first, second, and third impact regions 105*a*, *b*, and *c* (shown in FIGS. 2A and 2B), respectively. Referring to FIG. 4A, circuit segment 400*a* comprises a S1-PSS (switch—pressure sensitive switch) that corresponds to sensors 125*a*(1-3) and an LED1 that corresponds to indicator 115*a*. A timing circuit (555 Timer U1) is used to couple sensors 125*a*1-3 to indicator 115*a* in order to provide the needed indication duration of at least 8 seconds described above. Alternative timing circuits, such as the 556 Timer, may also be used. According to an exemplary embodiment of the invention, the 555 Timer is operated in a monostable mode but with a 100 nF (25-100 nF) capacitor C4 connected in parallel with sensors 125*a* to the trigger (pin 2) of the 555 Timer. As an example, a resistor R1 (e.g., 10 kΩ) is connected between VCC1 and the trigger (pin 2); a resistor R2 (e.g., 150 kΩ) is connected between VCC1 (9V power source, such as one or more batteries and the like) and the discharge (pin 7); a capacitor C3 (e.g., 16V 47 mF polarized capacitor) is connected between the discharge (pin 7) and ground (GND, pin 1); an ON-OFF switch S3 is connected between VCC1 and GND; S1-PSS (or sensors 125*a*1-3) is connected between the trigger (pin 2) and GND; and LED1 is connected to output (pin 3) via a "handedness" switch (S2) for switching between right handed (green) and left handed (red) use. As a result of adding C4 to the trigger (pin 2), upon being energized—by, say, an on-off switch and connection to power source VCC1 (9V)—an initial impulse from the on/off switch (and power source) brings the trigger (pin 2) "LOW."

Figure 5:
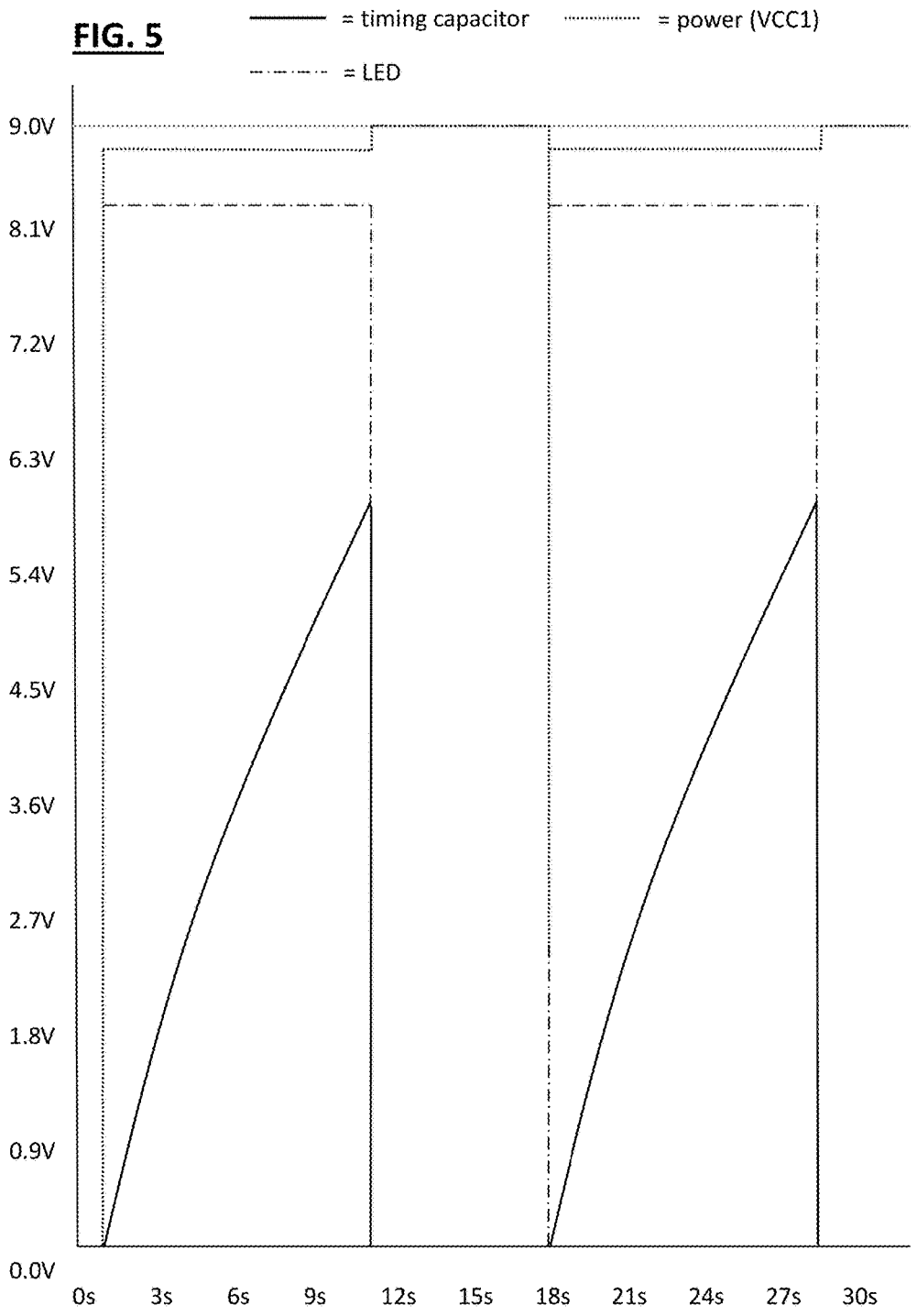
FIG. 5 is a simulation graph indicating voltage levels over time at respective portions of a circuit having an arrangement corresponding to each circuit segment illustrated in FIGS. 4A, 4B, and 4C, respectively.

FIG. 5 is a simulation graph indicating the respective voltage levels of a circuit having an arrangement corresponding to circuit segment 400*a* illustrated in FIG. 4A (and circuit segments 400*b* and 400*c* detailed below). As shown in FIG. 5, at t=1 second in the graph when power is applied to the circuit (via an ON-OFF switch (S3) and/or connection to a power source (VCC1)), the timer is initiated. In the simulation, the pressure sensitive switch (S1-PSS or sensor 125*a*1-3) is activated at 18 seconds and it also brings the trigger "LOW," again initiating the timer. As reflected in FIG. 5, the LED (LED1 or indicator 115*a*) is triggered upon either an initial power on or a sensor 125*a* being triggered, resulting in an approximately 8-10 second "ON" duration for indicator 115*a*. In other words, indicator 115*a* is triggered as if an impact is detected at any of sensors 125*a*1-3 upon powering on apparatus 100. Advantageously, a golfer may be presented with a preview on how the indicator 115*a* would function, and that it is functioning properly, each time the apparatus 100 is turned on.

Correspondingly, referring to FIG. 4B, circuit segment 400*b* comprises a S1-PSS2 (switch—pressure sensitive switch) that corresponds to sensors 125*b*(1-3) and an LED4 that corresponds to indicator 115*b*. A timing circuit (555 Timer U1) is used to couple sensors 125*b*1-3 to indicator 115*b* in order to provide the needed indication duration of at least 8 seconds described above. Alternative timing circuits, such as the 556 Timer, may also be used. According to an exemplary embodiment of the invention, the 555 Timer is operated in a monostable mode but with a 100 nF (25-100 nF) capacitor C8 connected in parallel with sensors 125*b* to the trigger (pin 2) of the 555 Timer. As an example, a resistor R7 (e.g., 10 kΩ) is connected between VCC1 and the trigger (pin 2); a resistor R8 (e.g., 150 kΩ) is connected between VCC1 (9V power source, such as one or more batteries and the like) and the discharge (pin 7); a capacitor C7 (e.g., 16V 47 mF polarized capacitor) is connected between the discharge (pin 7) and ground (GND, pin 1); S1-PSS2 (or sensors 125*b*1-3) is connected between the trigger (pin 2) and GND; and LED4 (yellow) is connected to output (pin 3). As a result of adding C4 to the trigger (pin 2), upon being energized—by, say, an on-off switch or connection to power source VCC1 (9V)—an initial impulse from the on/off switch (or power source) brings the trigger (pin 2) "LOW."

As described above, LED4 is yellow (or 595 nm) for indicating a "thin shot" impact, which is the same for both right handed and left handed use by virtue of being situated in the center region 105*b* of the sensor mat 105, as shown in FIG. 2.

Referring to FIG. 4C, circuit segment 400*c* comprises a S1-PSS1 (switch—pressure sensitive switch) that corresponds to sensors 125*c*(1-3) and an LED2 that corresponds to indicator 115*c*. A timing circuit (555 Timer U1) is used to couple sensors 125*c*1-3 to indicator 115*c* in order to provide the needed indication duration of at least 8 seconds described above. Alternative timing circuits, such as the 556 Timer, may also be used. According to an exemplary embodiment of the invention, the 555 Timer is operated in a monostable mode but with a 100 nF (25-100 nF) capacitor C6 connected in parallel with sensors 125*c* to the trigger (pin 2) of the 555 Timer. As an example, a resistor R4 (e.g., 10 kΩ) is connected between VCC1 and the trigger (pin 2); a resistor R5 (e.g., 150 kΩ) is connected between VCC1 (9V power source, such as one or more batteries and the like) and the discharge (pin 7); a capacitor C5 (e.g., 16V 47 mF polarized capacitor) is connected between the discharge (pin 7) and ground (GND, pin 1); S1-PSS1 (or sensors 125*c*1-3) is connected between the trigger (pin 2) and GND; and LED2 is connected to output (pin 3) via the "handedness" switch S2 for switching between right handed (red) and left handed (green) use. As a result of adding C4 to the trigger (pin 2), upon being energized—by, say, an on-off switch or connection to power source VCC1 (9V)—an initial impulse from the on/off switch (or power source) brings the trigger (pin 2) "LOW."

Referring back to FIG. 5, at t=1 second in the graph when power is applied to the circuit (via an ON-OFF switch (S3) and/or connection to a power source (VCC1)), the timer is initiated. In the simulation, the pressure sensitive switch (S1-PSS1/S1-PSS2 or sensor 125*b*1-3/125*c*1-3) is activated at 18 seconds and it also brings the trigger "LOW," again initiating the timer. As reflected in FIG. 5, the LED (LED4/LED2 or indicator 115*b*/115*c*) is triggered upon either an initial power on or a sensor 125*b*/125*c* being triggered, resulting in an approximately 8-10 second "ON" duration for indicator 115*b*/*c*. In other words, indicator 115*b*/*c* is triggered as if an impact is detected at any of sensors 125*b*1-3/125*c*1-3 upon powering on apparatus 100.

Circuit segments 400*a*, 400*b*, and 400*c* are connected in parallel at points A, B, C, and D shown in FIGS. 3A, 3B, and 3C to form a single circuit 400 for apparatus 100 in accordance with an exemplary embodiment of the invention. Accordingly, all indicators 115*a*, 115*b*, and 115*c* are triggered upon powering on apparatus 100 and a golfer is presented with a preview on how all of the indicators 115*a*, 115*b*, and 115*c* would function, and that each is functioning properly, when the apparatus 100 is turned on.

As described above, circuitry 400 provides for an "ON" duration for indicators 115 (LEDs) of approximately 8-10 seconds upon activation of the circuit itself or a corresponding one of the sensors 125. As further described, apparatus 100 may be configured specifically for shorter shots or may comprise a switch for changing between a "long shot mode," as described above with 8-10 second indicator 115 durations, and a "short shot mode," with, say, 4-5 second indicator durations. For a "short shot" apparatus 100, R1, R4, and R7 shown in FIGS. 4A-C, respectively, may be replaced with, for example, 5 kΩ resistors for approximately half the indicator durations of circuitry 400 shown in FIGS. 4A-C—i.e., 4-5 seconds. According to an exemplary embodiment of the invention, R1, R4 and R7 may be connected between VCC1 and their respective triggers (pin 2) in parallel with a respective additional resistor (with, say, the same resistance of 10 kΩ) that may be activated by a "mode change" switch (not shown)—for example, a 3-pole switch. Consequently, closing this "mode change" switch would effectively halve the resistances at R1, R4, and R7 and, correspondingly, the indicator durations. As a result, such a "mode change" switch may be incorporated in the apparatus 100 for switching between a "long shot mode," with longer indicator durations (e.g., 8-10 seconds), and a "short shot mode," with corresponding shorter indicator durations (e.g., 4-5 seconds).

In accordance with an alternative embodiment, apparatus 100 may embody one or more processors in place of the particular timing circuits and corresponding components, where the above-described timing features are implemented with programmed logic. Noting that such processors may increase production costs, additional features may be implemented in the programmed logic such as, without limitation, identifying and timing particular impact points upon mat 105 in order to determine a swing path/plane of the golfer in addition to identifying "ideal," "thick," and "thin" impacts—for example, identifying, distinguishing between, and timing impacts at sensors 125*b*2-125*a*1, 125*b*2-125*a*3, and 125*b*2-125*a*2, etc.

As discussed above, alternative timing circuits may be used in place of the 555 timers, such as the 556 timer, which would result in flashing indications at indicators 115, instead of steady indications with the 555 timer, with corresponding durations.

"And/or" as used herein, for example, with option A and/or option B, encompasses the separate embodiments of (i) option A, (ii) option B, and (iii) option A plus option B. Where a numerical range is provided herein, it is understood that all numerical subsets of that range, and all the individual integers contained therein and one tenth portions thereof, are provided as part of the invention as individual embodiments.

Now that the preferred embodiments of the present invention have been shown and described in detail, various modifications and improvements thereon will become readily apparent to those skilled in the art. Accordingly, the spirit and scope of the present invention is to be construed broadly and not limited by the foregoing specification.

The invention claimed is:

1. An apparatus, comprising:

one or more first sensors disposed under a first region of a golf mat;

one or more second sensors disposed a predetermined distance from the one or more first sensors under a second region of the golf mat;

one or more third sensors disposed the predetermined distance from the one or more second sensors under a third region of the golf mat;

a circuit coupling each of the first, second, and third sensors to a respective first indicator, second indicator, and third indicator, the circuit triggering, over a predetermined amount of time, one or more of the first indicator upon the one or more first sensors detecting an impact in the first region on the golf mat, the second indicator upon the one or more second sensors detecting an impact in the second region on the golf mat, and the third indicator upon the one or more third sensors detecting an impact in the third region on the golf mat; and a switch that switches outputs of the first and third indicators between respectively indicating an ideal impact detection and a fat impact detection and respectively indicating a fat impact detection and an ideal impact detection.

2. The apparatus according to claim 1, wherein the predetermined amount of time is at least approximately 8 seconds.

3. The apparatus according to claim 1, wherein the first, second, and third sensors are disposed between a top layer and a bottom layer of a sensor mat each made from a rubber or vinyl material.

4. The apparatus according to claim 3, wherein the top layer and the bottom layer of the sensor mat each have a thickness of approximately 1/16 to 3/32 inches.

5. The apparatus according to claim 1, wherein the circuit triggers all of the first, second, and third indicators over the predetermined amount of time upon coupling to an energy source.

6. The apparatus according to claim 5, wherein the circuit comprises three segments each comprising a respective timing circuit and each assigned to the respective one or more first, second, and third sensors.

7. The apparatus according to claim 6, wherein each respective timing circuit is connected to a respective trigger capacitor in parallel with the respective one or more first, second, and third sensors.

8. The apparatus according to claim 7, wherein each respective trigger capacitor has a capacitance in the range of approximately 25-100 nF.

9. The apparatus according to claim 1, wherein the first, second, and third sensors are respectively arranged along first, second, and third axes that are orthogonal to a swing direction axis along which the first, second, and third regions are arranged.

10. The apparatus according to claim 1, wherein the second indicator comprises a yellow LED for indicating a thin impact detection and the first and third indicators are each switchable, by the switch, between a red LED for indicating the fat impact detection and a green LED for indicating the ideal impact detection.

11. A method, comprising:

providing one or more first sensors under a first region of a golf mat;

providing one or more second sensors a predetermined distance from the one or more first sensors under a second region of the golf mat;

providing one or more third sensors the predetermined distance from the one or more second sensors under a third region of the golf mat;

detecting, by the one or more first, second, and third sensors, a golf swing impact on the golf mat, wherein upon detecting the golf swing impact in the first region, triggering, by the circuit, the first indicator over the predetermined amount of time;

upon detecting the golf swing impact in the second region, triggering, by the circuit, the second indicator over the predetermined amount of time, and upon detecting the golf swing impact in the third region, triggering, by the circuit, the third indicator over the predetermined amount of time; and providing a switch that switches outputs of the first and third indicators between respectively indicating an ideal impact detection and a fat impact detection and respectively indicating a fat impact detection and an ideal impact detection.

12. The method according to claim 11, wherein the predetermined amount of time is at least approximately 8 seconds.

13. The method according to claim 11, wherein all of the first, second, and third indicators are triggered over the predetermined amount of time upon coupling the circuit to an energy source.

* * * * *